US009358667B2

(12) United States Patent
Arnold et al.

(10) Patent No.: US 9,358,667 B2
(45) Date of Patent: Jun. 7, 2016

(54) SYSTEM AND METHOD FOR LOW PRESSURE PIERCING USING A WATERJET CUTTER

(71) Applicant: Waterjet Holdings, Inc., Kent, WA (US)

(72) Inventors: Halan P. Arnold, Aberdeen, WA (US); Mohamed A. Hashish, Bellevue, WA (US); Adrian Hawes, Seattle, WA (US); Steven J. Craigen, Auburn, WA (US)

(73) Assignee: Shape Technologies Group, Inc., Baxter Springs, KS (US)

( * ) Notice: Subject to any disclaimer, the term of this patent is extended or adjusted under 35 U.S.C. 154(b) by 42 days.

(21) Appl. No.: 14/528,041

(22) Filed: Oct. 30, 2014

(65) Prior Publication Data

US 2016/0121457 A1 May 5, 2016

(51) Int. Cl.
*B24C 7/00* (2006.01)
*B24C 1/04* (2006.01)

(52) U.S. Cl.
CPC ..... *B24C 7/0023* (2013.01); *B24C 1/045* (2013.01)

(58) Field of Classification Search
CPC ..... B24C 7/0023; B24C 1/045; B24C 3/322; B24C 7/0046; B24C 3/062; B26F 3/004
USPC ..... 451/2, 36–40
See application file for complete search history.

(56) References Cited

U.S. PATENT DOCUMENTS 2,985,050 A * 5/1961 Schwacha ..... B26F 3/004 125/23.01
3,628,727 A 12/1971 Gjerde
3,845,586 A * 11/1974 Callahan ..... B24C 5/005 451/101
3,961,754 A 6/1976 Kuhns et al.
4,074,858 A 2/1978 Burns et al.
4,555,872 A * 12/1985 Yie ..... B05B 7/1431 451/102
4,700,422 A 10/1987 Russell
4,744,517 A 5/1988 Iwamoto et al.
4,913,345 A 4/1990 Setter (Continued)

FOREIGN PATENT DOCUMENTS

WO 01/45854 6/2001

OTHER PUBLICATIONS

Alibaba Website, Shenyang All-Powerful Science & Technology Stock Co., Ltd., <http://waterjet.en.alibaba.com/product/1257015279-220127656/APW_water_jet_hydraulic_motor_and_pump.html> webpage accessed Jan. 20, 2014.

(Continued)

*Primary Examiner* — George Nguyen
(74) *Attorney, Agent, or Firm* — Michael Best & Friedrich LLP

(57) ABSTRACT

A high-pressure waterjet cutting system includes a pump operable to produce a flow of pressurized hydraulic fluid, a piston receiving the flow of pressurized hydraulic fluid and reciprocating in response to a pressure differential produced by the flow of pressurized hydraulic fluid, and an intensifier connected to the piston and operable to produce a high-pressure flow of water in response to reciprocation of the piston. A valve is positioned to receive the flow of hydraulic fluid and is movable between a first position in which the pressure differential is a first value and a second position in which the pressure differential is a second value less than the first value.

21 Claims, 3 Drawing Sheets

(56) References Cited

U.S. PATENT DOCUMENTS

| | | | | |
|---|---|---|---|---|
| 5,092,744 | A | 3/1992 | Boers et al. | |
| 5,385,452 | A | 1/1995 | Lyday | |
| 5,694,966 | A | 12/1997 | Holder | |
| 5,782,673 | A * | 7/1998 | Warehime | B24C 1/045 451/2 |
| 6,220,529 | B1 * | 4/2001 | Xu | B24C 1/045 137/872 |
| 6,425,805 | B1 * | 7/2002 | Massa | B24C 5/04 239/433 |
| 7,600,460 | B2 | 10/2009 | Manders | |
| 8,038,413 | B2 | 10/2011 | Gilpatrick | |
| 8,496,188 | B2 | 7/2013 | Linton et al. | |
| 2003/0106591 | A1 | 6/2003 | Saurwein et al. | |
| 2003/0148709 | A1 * | 8/2003 | Anand | B24C 1/045 451/39 |
| 2004/0046069 | A1 * | 3/2004 | Gromes | B05B 1/10 239/596 |
| 2005/0230152 | A1 * | 10/2005 | Joslin | B24C 1/045 175/67 |
| 2007/0221023 | A1 * | 9/2007 | Yoshida | B23H 5/04 83/53 |
| 2008/0032610 | A1 * | 2/2008 | Chacko | B24C 1/045 451/102 |
| 2010/0088894 | A1 * | 4/2010 | Stark | B24C 1/045 29/890.142 |
| 2011/0124270 | A1 * | 5/2011 | Liwszyc | B24C 1/045 451/40 |
| 2012/0196516 | A1 | 8/2012 | Funatsu et al. | |
| 2012/0252326 | A1 * | 10/2012 | Schubert | B24C 1/045 451/60 |
| 2014/0072453 | A1 * | 3/2014 | Vandergon | B26F 3/004 417/53 |

OTHER PUBLICATIONS

Sensagent, Definition—Pressure washer, <http://dictionary.sensagent.com/pressure%20washer/en-en/> webpage accessed Jan. 23, 2014.

Written Opinion of the International Searching Authority for Application No. PCT/US15/50726 dated Jan. 28, 2016 (6 pages).

Search Report of the International Searching Authority for Application No. PCT/US15/50726 dated Jan. 28, 2016 (11 pages).

* cited by examiner

SYSTEM AND METHOD FOR LOW PRESSURE PIERCING USING A WATERJET CUTTER

BACKGROUND

The present invention relates to a system and method for low pressure piercing using a waterjet cutter.

Precision cutting for industrial and commercial purposes is often accomplished through the use of a waterjet system that directs a high speed stream of water at a workpiece. Waterjet cutting uses ultra-high pressure water, typically over 15,000 psi, produced on-site with special equipment, to produce a high velocity stream of water traveling at speeds in excess of Mach 2. This high-velocity stream, often mixed with abrasives, is capable of cutting hard materials such as metal and granite with thicknesses of more than a foot. Among other benefits, waterjet cutting eliminates the adverse effects of high temperature zones and material deformation generated during traditional cutting methods.

SUMMARY

In one embodiment of a high-pressure waterjet cutting system, the system includes a pump operable to produce a flow of pressurized hydraulic fluid, a piston receiving the flow of pressurized hydraulic fluid and reciprocating in response to a pressure differential produced by the flow of pressurized hydraulic fluid, and an intensifier connected to the piston and operable to produce a high-pressure flow of water in response to reciprocation of the piston. A valve is positioned to receive the flow of hydraulic fluid and is movable between a first position in which the pressure differential is a first value and a second position in which the pressure differential is a second value less than the first value.

Another embodiment provides a method of operating a high-pressure waterjet cutting system for a piercing operation on a workpiece to be cut. The method includes operating a hydraulic pump at a non-zero minimum speed to produce a flow of hydraulic fluid, directing the flow of hydraulic fluid to a piston to define a first pressure differential and to produce reciprocation of the piston, and operating an intensifier in response to reciprocation of the piston to produce a flow of high-pressure water at a first pressure. The method also includes moving a valve from a first position toward a second position to reduce the pressure differential to a second pressure differential and to produce a flow of high-pressure water at a second pressure that is lower than the first pressure and directing the flow of high-pressure water at the second pressure to a waterjet cutting head to pierce the workpiece. The method further includes moving the valve to the first position and increasing the speed of the hydraulic pump to a normal speed to produce a third pressure differential that is greater than the first pressure differential and the second pressure differential to produce a flow of high-pressure water at a third pressure that is greater than the first pressure and the second pressure, and performing a cutting operation on the workpiece.

Another embodiment of a high-pressure waterjet cutting system includes a pump operable at a normal speed to produce a flow of hydraulic fluid having a pressure, and a hydraulic drive including a piston that reciprocates within a space that defines a first chamber and a second chamber, the hydraulic drive defining a first pressure differential having a first value when the pump operates at the normal speed. A directional control valve is operable to cyclically deliver the flow of hydraulic fluid to one of the first chamber and the second chamber and to direct a flow of drained hydraulic fluid from the other of the first chamber and the second chamber to produce a back-and-forth reciprocation of the piston, and a valve is positioned to vary one of the flow of hydraulic fluid and the flow of drained hydraulic fluid to produce a second pressure differential having a value below the first pressure differential.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations herein are meant to encompass the items listed thereafter and equivalents thereof as well as additional items.

DETAILED DESCRIPTION

One of ordinary skill in the art will realize that unique problems occur at ultra-high pressures. Thus, solutions common to lower pressure pumps are not necessarily applicable to systems operating at pressures in excess of 15,000 psi and, in fact, can produce results contrary to those seen in low pressure operation. Thus, for the purposes of this application, the terms "high pressure" or any modifications of high-pressure will be referring to pressures that typically exceed 15,000 psi.

Figure 1:
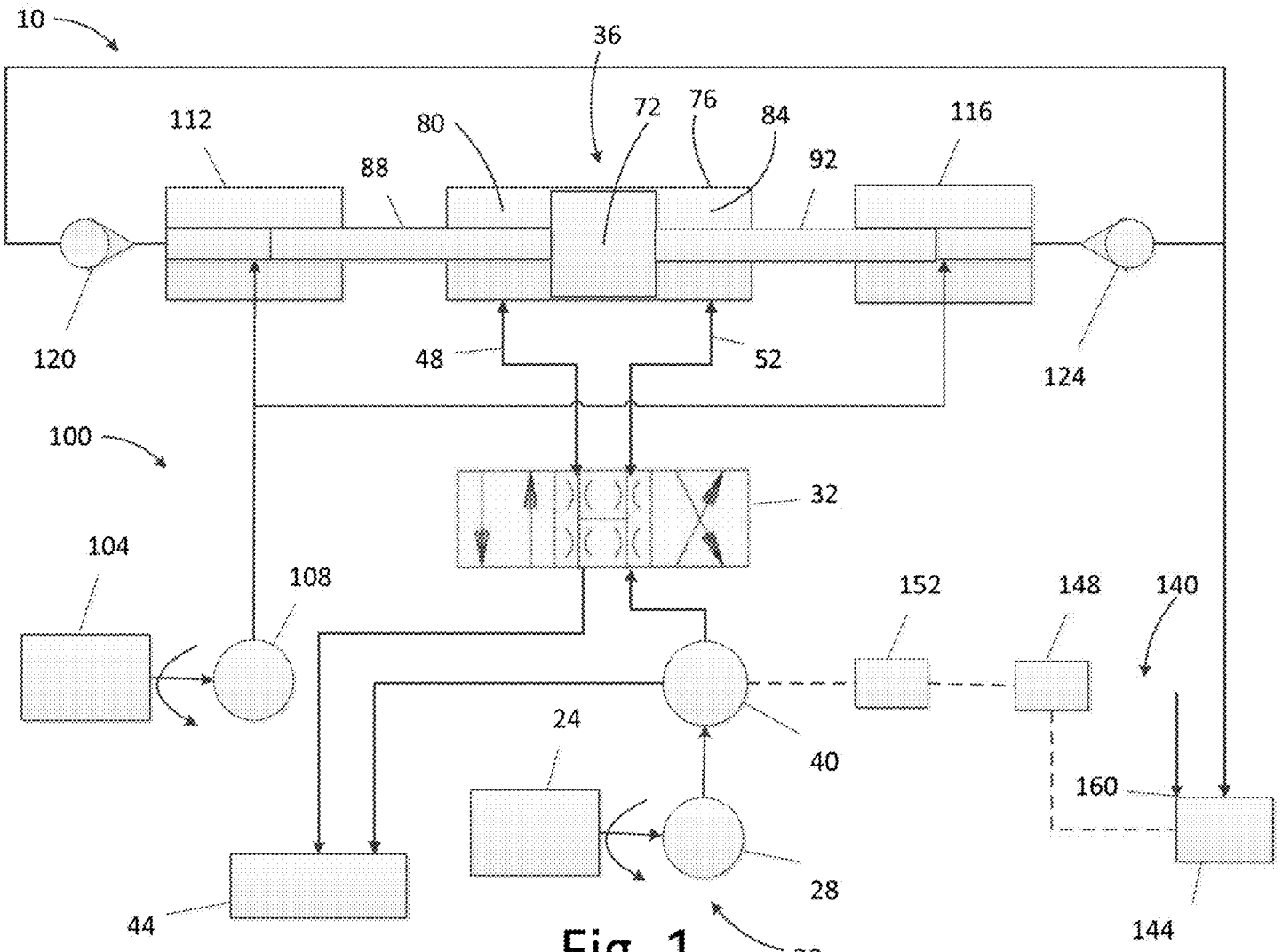
FIG. 1 is a schematic illustration of a high-pressure waterjet cutting system.

FIG. 1 schematically illustrates a high-pressure waterjet cutting system 10. The cutting system 10 includes a hydraulic system 20 that uses hydraulic fluid to drive a high-pressure water system 100. The high-pressure water is then used for a cutting operation in a high-pressure waterjet cutter 140.

The hydraulic system 20 includes a motor 24, a hydraulic pump 28, a flow control valve 32, a hydraulic drive 36, a pressure control valve in the form of an unloader valve 40, a hydraulic oil sump 44 for collecting low pressure hydraulic fluid, and a series of pipes and other hardware that interconnect the various components. The pipes include first and second chamber pipes 48, 52 between the flow control valve 32 and the hydraulic drive 36. The motor 24 can include an electrical motor, a gas-powered motor, or any other suitable prime mover, and operates to drive the hydraulic pump 28. The hydraulic pump 28 operates in response to operation of the motor 24 to discharge a flow of pressurized hydraulic fluid (oil, butanal, esters, etc.) through the pipes of the hydraulic system 20. While any suitable pump can be employed (e.g., reciprocating, centrifugal, scroll, etc.) preferred constructions employ a rotary screw pump.

The flow control valve 32 is preferably a four way valve with other types of valves being possible. The flow control valve 32 includes an inlet that is connected via piping to the outlet of the hydraulic pump 28 to receive the flow of pressurized fluid. The flow control valve 32 also includes two high-pressure outlets and a low pressure outlet. The flow control valve 32 is movable between a first position and a second position in response to either a mechanical or electrical control signal. In the first position, the flow control valve 32 defines a first flow path between the inlet and a first of the two high-pressure outlets and a second flow path between the second of the two high-pressure outlets and the low pressure outlet. In this position, the flow of pressurized hydraulic fluid passes through the flow control valve 32, out through the first high-pressure outlet, and through the first chamber pipe 48. In the second position, the flow control valve 32 defines a third flow path between the inlet and the second of the two high-pressure outlets and a fourth flow path between the first of the two high-pressure outlets and the low pressure outlet. In this position, the flow of pressurized hydraulic fluid passes through the flow control valve 32, out through the second high-pressure outlet, and into the second chamber pipe 52.

The hydraulic drive 36 includes a piston 72 disposed within a cylinder 76. The cylinder 76 includes a first end and a second end with a cylindrical wall extending between the ends to define a cylinder volume. A first fluid connection is positioned adjacent the first end and is fluidly coupled to the first chamber pipe 48. A second fluid connection is positioned adjacent the second end and is fluidly coupled to the second chamber pipe 52. The piston 72 is positioned within the cylinder 76 such that it divides the cylinder 76 into a first chamber 80 and a second chamber 84. A first shaft 88 extends from the piston 72 and out the first end of the cylinder 76 and a second shaft 92 extends from the piston 72 and out the second end of the cylinder 76. Thus, the first fluid connection is in fluid communication with the first chamber 80 and the second fluid connection provides for fluid communication with the second chamber 84.

As illustrated in FIG. 1, the unloader valve 40 is situated between the hydraulic pump 28 and the flow control valve 32. Of course other arrangements and positions are possible. The unloader valve 40 includes a casing that defines an inlet, a first outlet, and a second outlet, and that contains a movable member. In some constructions, the unloader valve 40 is one of a solenoid valve, gate valve, ball valve, butterfly valve, or the like with other types of valves also being suitable. The movable member is movable between a first position and a second position. When the movable member is in the first position, the inlet and the first outlet are in direct fluid communication. When the movable member is in the second position, the inlet and the second outlet are in direct fluid communication. When the movable member is between the first position and the second position, and not in either position, fluid flow from the inlet to both the first outlet and the second outlet is possible. The position of the movable member can be controlled manually or through an electronic or other drive arrangement as may be desired. In some constructions, the second outlet is sized to allow for the passage of only a portion of the total flow that passes through the unloader valve 40. In this construction, the unloader valve 40 allows flow through both the first outlet and the second outlet even when the movable member is in the second position.

With continued reference to FIG. 1, the illustrated high-pressure water system 100 includes a water system motor 104, water pump 108, first and second intensifiers 112, 116, first and second check valves 120, 124, and a series of pipes and other hardware fluidly interconnecting the various components. The water system motor 104 and water pump 108 work in conjunction to provide a source of pressurized water for the high-pressure water system 100. As such, other arrangements may include other sources or mechanisms to provide this source of water. In the illustrated construction, the water system motor 104 can include an electric motor or any other suitable prime mover. The water pump 108 may include any suitable pump that is capable of providing water at the necessary pressure and flow rate for the high-pressure water system 100. The actual source of water for this system is not critical to the invention.

The first intensifier 112 is virtually identical to the second intensifier 116, with each intensifier coupled to one of the first shaft 88 or the second shaft 92 of the piston 72. Because the intensifiers 112, 116 are similar, only the first intensifier 112 will be described in detail. The first intensifier 112 includes a cylindrical body, a seal head, and an intensifier piston. The cylindrical body includes a first end, a second end, and a cylindrical space that extends between the first end and the second end. A water inlet is formed in the cylindrical body and is positioned to direct a flow of water into the cylindrical space. In preferred constructions, an inlet check valve is positioned at the water inlet to control the flow of water into the cylindrical body and to inhibit the flow of water out of the cylindrical body via the inlet.

The intensifier piston is positioned within the cylindrical body to occupy a portion of the cylindrical space. The intensifier piston is coupled to one of the shafts 88, 92 such that the intensifier piston reciprocates within the cylindrical body in response to reciprocating movement of the piston 72. The seal head is connected to the cylindrical body to seal the second end of the cylindrical body and enclose the cylindrical space between the second end and the first end of the intensifier piston. In preferred constructions, the seal head includes a discharge flow path and a discharge check valve 120, 124 arranged to open and discharge the high-pressure water produced by the intensifiers 112, 116. The design and arrangement of the intensifier is not critical to the operation of the system described herein. As such, other arrangements and designs are possible.

With continued reference to FIG. 1, the high-pressure waterjet cutter 140 includes a cutting head 144, and a support system for supporting the cutting head 144 (not shown). In addition, the cutting head 144 may include a pressure sensor 148 and a controller 152. The cutting head 144 includes an inlet for receiving ultra high-pressure water, an outlet for discharging the water or a cutting solution, and may include a second inlet 170 for an abrasive. The second inlet 170 allows for a feeding system (not shown) to supply an abrasive material, such as garnet, aluminum oxide, or olivine to be combined with the flow of water in the cutting head 144, thereby producing the cutting solution.

The pressure sensor 148 measures the pressure of the flow of water at the cutting head 144 and provides the measured value to the controller 152. The pressure sensor 148 may alternatively be configured to take pressure measurements at the exits of the check valves 120, 124 or at a location in the pipes of the system 10 between the check valves 120, 124 and the cutting head 144.

The controller 152 is preferably a microprocessor-based controller that includes some form of memory or data storage, a processor, and an input/output device. In the illustrated construction, the controller 152 uses the measured pressure data provided by the pressure sensor 148, along with user inputs, to determine and set the desired position of the unloader valve 40, as will be discussed in greater detail with the operation of the device. As one of ordinary skill will realize, other controllers including mechanical, electrical, PLC-based, and manual controllers are possible.

The system of FIG. 1 is operable in an ultra high-pressure mode and a high-pressure mode. In the ultra-high pressure mode, the motors 24, 104 are operated to drive the hydraulic pump 28 and the water pump 108, respectively. Pressurized hydraulic fluid flows from the hydraulic pump 28 to the inlet of the unloader valve 40. In the ultra-high pressure mode, the movable member of the unloader valve 40 is in the first position and the pressurized fluid flows through the unloader valve 40 and out the first outlet. The flow then enters the flow control valve 32 where it is directed to one of the first chamber 80 and the second chamber 84 in rapid succession to produce a reciprocating movement of the hydraulic drive 36. Specifically, the flow control valve 32 moves to the first position to direct the pressurized hydraulic fluid to the first chamber 80. This causes the piston 72 to move toward the second chamber 84 and forces the fluid from the second chamber 84 and out the second inlet to the flow control valve 32. The fluid is then discharged to the sump 44. The position of the flow control valve 32 is periodically reversed to direct the pressurized fluid to the second chamber 84. This causes the piston 72 to move toward the first chamber 80 and forces the fluid from the first chamber 80 out the first inlet to the flow control valve 32. The fluid is then discharged to the sump 44. In this mode, the pressure difference between the first chamber 80 and the second chamber 84 is at a maximum.

The reciprocating motion of the piston 72 provides a similar reciprocating movement of the intensifier pistons of the intensifiers 112, 116. In preferred arrangements, the intensifiers 112, 116 are arranged such that while one intensifier is compressing water, the other intensifier is drawing water into the intensifier. In this way, ultra high-pressure water is provided for each stroke of the piston 72.

The high pressure mode of operation is identical to the ultra high-pressure mode of operation except that the movable element of the unloader valve 40 is moved toward or into its second position. In this position, a portion of the pressurized hydraulic fluid exits the unloader valve 40 through the second outlet and is directly returned to the sump 44. Thus, a smaller quantity of hydraulic fluid is provided to the flow control valve 32, thereby reducing the quantity of water that can be pumped by the intensifiers 112, 116. In this mode, the pressure difference between the first chamber 80 and the second chamber 84 is less than the maximum pressure difference.

The water from the intensifiers 112, 116 flows through the cutting head 144, where the pressure is converted to velocity and the water is discharged to cut a workpiece as is known in the art. In the high-pressure mode of operation, less water (or water at a lower pressure) is available at the cutting head 144, thereby producing a lower velocity stream of water for cutting.

Figure 2:
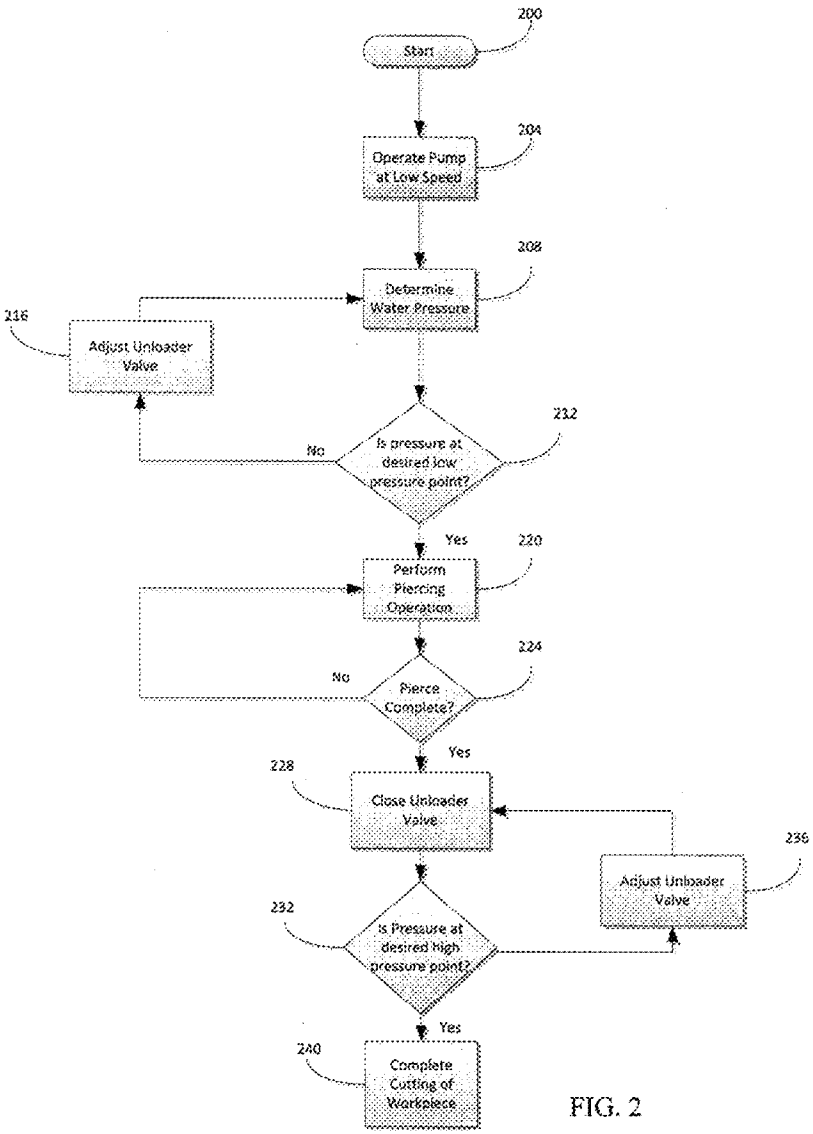
FIG. 2 is a flow chart illustrating a method of operating the waterjet cutting system of FIG. 1 for a piercing operation.

The flowchart of FIG. 2 illustrates operation of the high-pressure waterjet cutting system 10 in a piercing operation starting with block 200. The motor 24 and hydraulic pump 28 are first slowed to operate at a speed lower than the normal operating speed (see block 204). The minimum operating speeds of the motor 24 and the hydraulic pump 28 are typically the lowest speeds at which the hydraulic pump 28 is capable of providing a flow of pressurized fluid. Below this value, the hydraulic pump 28 is not capable of providing a usable flow. Thus, efficient operation of the hydraulic pump 28 and motor 24 are only possible at speeds above certain minimal levels.

The water pressure is then measured by the pressure sensor 148 (see block 204). If the pressure of the water determined by the pressure sensor 148 is above the desired low piercing pressure, the unloader valve 40 may be moved toward the second position to divert hydraulic fluid away from the hydraulic drive 40 and to the sump 44 in order to lower the pressure of the flow of water (see blocks 212, 216). Alternatively, if the pressure measurement is lower than desired, the unloader valve 40 may be moved toward the first position to increase the flow of hydraulic fluid to the hydraulic drive 40.

In one construction, the unloader valve 40 may divert between 0 and 40 percent of the total amount of hydraulic fluid produced by the hydraulic pump 28. The unloader valve 40 may further be adjusted until the pressure reaches the desired low pressure suitable for piercing, for example, 15,000 psi or less. Of course, other constructions divert a larger percentage of the hydraulic fluid to produce even lower pressures as may be required.

Figure 3:
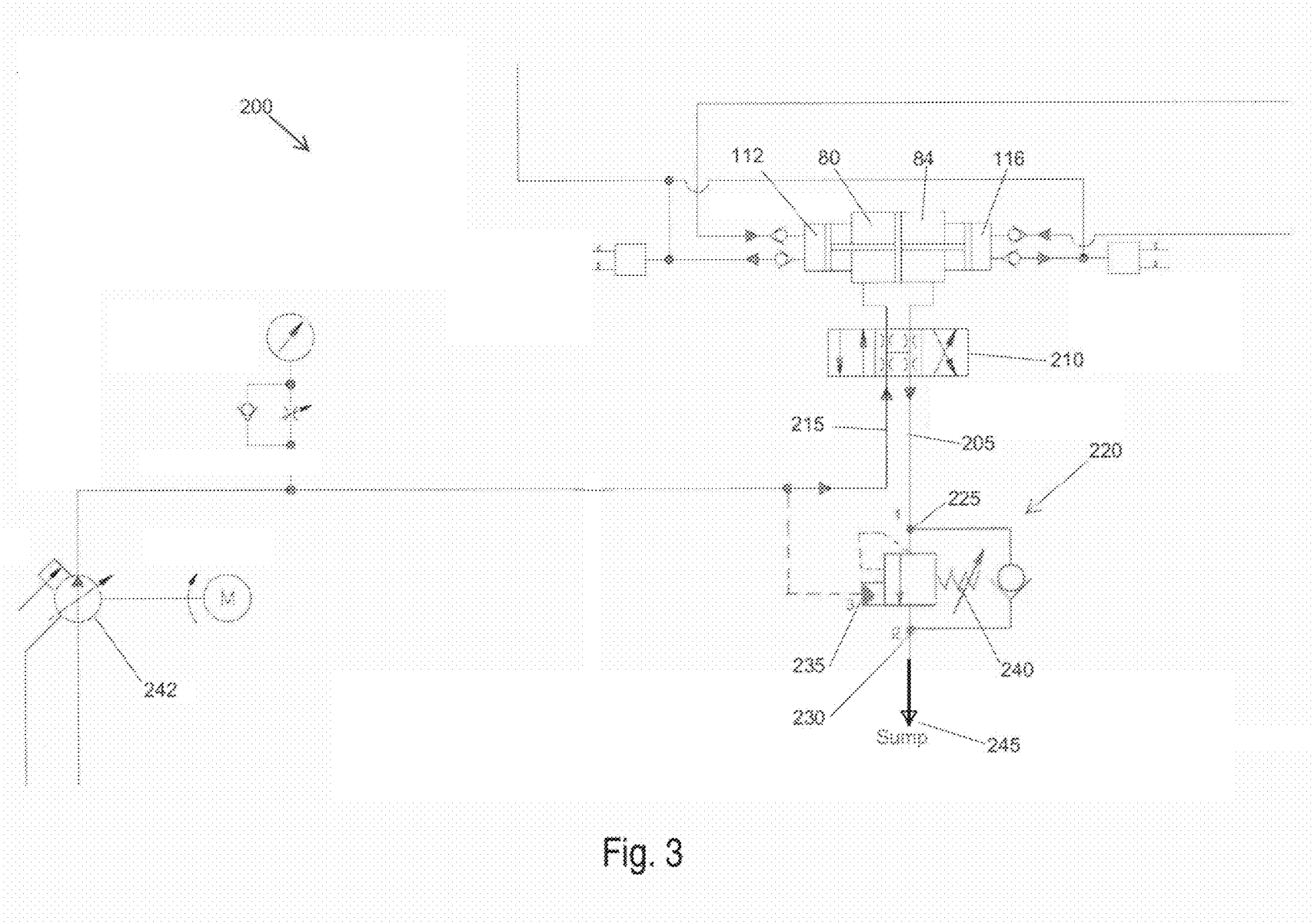
FIG. 3 is a schematic illustration of another arrangement of a high-pressure waterjet cutting system.

FIG. 3 illustrates another arrangement of a high-pressure waterjet cutting system 200 in which a pressure control valve is positioned on an outlet side 205 of a directional control valve 210 rather than an inlet side 215 of the directional control valve 210. As illustrated in FIG. 3, the pressure control valve is in the form of a counterbalance valve 220 having an inlet port 225, an outlet port 230, and a pilot pressure sensing port 235. The counterbalance valve 220 is movable between an open position in which flow from the inlet port 225 to the outlet port 230 is largely unrestricted and a closed position in which flow between the inlet port 225 and the outlet port 230 is restricted. A biasing member 240 in the form of an adjustable spring biases the valve 220 toward the closed position.

During operation of the construction illustrated in FIG. 3, the hydraulic pump 242 operates to deliver pressurized hydraulic fluid directly to the directional control valve 210. The directional control valve 210 operates as described with regard to FIGS. 1 and 2 to deliver the hydraulic fluid alternately to one of the chambers 80, 84. A portion of the hydraulic fluid is also directed to the pilot pressure sensing port 235. The directional control valve 210 directs pressurized hydraulic fluid to one of the chambers 80, 84 and allows fluid to drain from the other of the chambers 80, 84 during each reciprocation cycle. The drained fluid passes through the directional control valve 210 and enters the inlet port 225 of the counterbalance valve 220. When the hydraulic pump is at full operating pressure (i.e., the pump 242 is at normal speed), the pressure at the pilot pressure sensing port 235 is sufficient to overcome the biasing force of the biasing member 240 and move the counterbalance valve 220 to the full open position. In this position, the flow from the inlet port 225 to the outlet port 230 is largely unrestricted and the hydraulic fluid passes directly to the drain or sump 245 of the system. In this position, the back pressure in the chamber 80, 84 being drained is minimized and the pressure difference between the chambers 80, 84 is maximized.

During periods when a lower water pressure is desired, the pump pressure is first reduced, typically by reducing the speed of the pump. The reduction in pump output pressure lowers the pressure applied at the pilot pressure sensing port 235, thereby allowing the biasing member 240 to move the counterbalance valve 220 toward the closed position. As the counterbalance valve 220 moves toward the closed position, the drain path between the inlet port 225 and the outlet port 230 becomes restricted, thereby producing a backpressure in the chamber 80, 84 being drained. This backpressure reduces the pressure differential between the chambers 80, 84 and results in a corresponding reduction in the water pressure produced by the intensifiers 112, 116 and the waterjet cutter.

Once the water pressure is at the desired pressure for piercing, the waterjet cutting head 144 can direct the flow of water to pierce a workpiece until the workpiece is pierced (see blocks 220, 224). The piercing operation allows for the waterjet cutter 140 to pierce through the workpiece without fracturing or otherwise damaging the workpiece. Once pierced, the unloader valve 40 is closed to allow for a higher pressure flow of water to be emitted from the waterjet cutting head 144, for example, 30,000 psi or more (see blocks 228). The speed of the motor 24 and the hydraulic pump 28 may also be increased to increase the pressure of the flow of water. The unloader valve 40 may be further adjusted as described above until the water pressure reaches the desired pressure for cutting (see blocks 232, 236). Once the pressure is at the desired level, the workpiece may be cut (see block 240). In the construction of FIG. 3, once the piercing is completed, the hydraulic pump output pressure is increased to move the counterbalance valve 220 toward the open position to produce fully pressurized water for the waterjet cutter.

It should be noted that the embodiments illustrated herein utilize variable speed pumps and motors to vary the pressure of the hydraulic fluid. However, other methods such as pressure reducing valves and the like could be employed to control the pressure of the flow of hydraulic fluid.

Various features and advantages of the invention are set forth in the following claims.

What is claimed is:

1. A high-pressure waterjet cutting system comprising:

a pump operable to produce a flow of pressurized hydraulic fluid;

a piston receiving the flow of pressurized hydraulic fluid and reciprocating in response to a pressure differential produced by the flow of pressurized hydraulic fluid;

an intensifier connected to the piston and operable to produce a high-pressure flow of water in response to reciprocation of the piston;

a directional control valve operable to cyclically deliver the flow of hydraulic fluid to the piston and to direct a flow of drained hydraulic fluid from the piston to produce a back-and-forth reciprocation of the piston; and a valve positioned to receive the flow of hydraulic fluid and movable between a first position in which the pressure differential is a first value and a second position in which the pressure differential is a second value less than the first value.

2. The high-pressure waterjet cutting system of claim 1, wherein the pump is operable between a low speed and a normal speed, and wherein operation of the pump at the normal speed results in the first pressure differential and operation of the pump at the low speed results in the second pressure differential.

3. The high-pressure waterjet cutting system of claim 1, wherein the valve moves toward the second position in response to a reduction in a pressure of the pressurized hydraulic fluid.

4. The high-pressure waterjet cutting system of claim 1, wherein the piston includes a double acting piston that at least partially defines a first chamber and a second chamber, and wherein the pressure differential is the difference in pressure between the first chamber and the second chamber when the first chamber is receiving the flow of pressurized hydraulic fluid and the second chamber is draining a flow of hydraulic fluid.

5. The high-pressure waterjet cutting system of claim 4, wherein movement of the valve from the first position toward the second position reduces the pressure of the high pressure hydraulic fluid delivered to the first chamber.

6. The high-pressure waterjet cutting system of claim 4, wherein movement of the valve from the first position toward the second position diverts a portion of the flow of hydraulic fluid away from the piston, and wherein the portion of hydraulic fluid diverted away from the piston is more than 0 percent and less than 40 percent of the total flow of hydraulic fluid.

7. The high-pressure waterjet cutting system of claim 4, wherein movement of the valve from the first position toward the second position increases a back-pressure of the draining flow of hydraulic fluid exiting the second chamber.

8. The high-pressure waterjet cutting system of claim 1, wherein the valve includes a pressure sensing port in fluid communication with the high pressure flow of hydraulic fluid exiting the pump and a biasing member, and wherein the biasing member is arranged to bias the valve toward the second position and the high pressure flow of hydraulic fluid at the pressure sensing port produces a force that biases the valve toward the first position.

9. The high-pressure waterjet cutting system of claim 8, wherein the pump is operable at a normal speed to produce a first pressure at the pressure sensing port, and wherein the force produced in response to the first pressure is greater than the biasing force produced by the biasing member.

10. The high-pressure waterjet cutting system of claim 1, wherein the valve is manually operated.

11. The high-pressure waterjet cutting system of claim 1, further comprising a pressure sensor operable to measure a pressure of the high-pressure flow of water, and a controller operable to move the valve to a desired position in response to the measured pressure.

12. A method of operating a high-pressure waterjet cutting system for a piercing operation on a workpiece to be cut, the method comprising:

operating a hydraulic pump at a non-zero minimum speed to produce a flow of hydraulic fluid;

directing the flow of hydraulic fluid to a piston using a directional control valve to define a first pressure differential and to produce reciprocation of the piston;

operating an intensifier in response to reciprocation of the piston to produce a flow of high-pressure water at a first pressure;

moving a valve from a first position toward a second position to reduce the pressure differential to a second pressure differential and to produce a flow of high-pressure water at a second pressure that is lower than the first pressure;

directing the flow of high-pressure water at the second pressure to a waterjet cutting head to pierce the workpiece;

moving the valve to the first position and increasing the speed of the hydraulic pump to a normal speed to produce a third pressure differential that is greater than the first pressure differential and the second pressure differential to produce a flow of high-pressure water at a third pressure that is greater than the first pressure and the second pressure; and performing a cutting operation on the workpiece.

13. The method of operating the high-pressure waterjet cutting system for the piercing operation on the workpiece to be cut of claim 12, wherein the moving the valve step includes moving the valve manually.

14. The method of operating the high-pressure waterjet cutting system for the piercing operation on the workpiece to be cut of claim 12, the method further comprising measuring the pressure of the flow of high-pressure water using a pressure sensor; and adjusting the valve in response to the measured pressure.

15. The method of operating the high-pressure waterjet cutting system for the piercing operation on the workpiece to be cut of claim 12, wherein the moving the valve step includes automatically moving the valve in response to a pressure of the flow of hydraulic fluid.

16. The method of operating the high-pressure waterjet cutting system for the piercing operation on the workpiece to be cut of claim 12, wherein the moving a valve from a first position toward a second position to reduce the pressure differential to a second pressure differential step includes reducing a pressure of the flow of hydraulic fluid directed to the piston.

17. The method of operating the high-pressure waterjet cutting system for the piercing operation on the workpiece to be cut of claim 12, wherein the moving a valve from a first position toward a second position to reduce the pressure differential to a second pressure differential step includes increasing a back pressure of a draining flow of hydraulic fluid flowing from the piston.

18. A high-pressure waterjet cutting system comprising:

a pump operable at a normal speed to produce a flow of hydraulic fluid having a pressure;

a hydraulic drive including a piston that reciprocates within a space that defines a first chamber and a second chamber, the hydraulic drive defining a first pressure differential having a first value when the pump operates at the normal speed;

a directional control valve operable to cyclically deliver the flow of hydraulic fluid to one of the first chamber and the second chamber and to direct a flow of drained hydraulic fluid from the other of the first chamber and the second chamber to produce a back-and-forth reciprocation of the piston; and a valve positioned to vary one of the flow of hydraulic fluid and the flow of drained hydraulic fluid to produce a second pressure differential having a value below the first pressure differential.

19. The high-pressure waterjet cutting system of claim 18, wherein the valve is positioned between the pump and the hydraulic drive and is movable between a first position in which the entire flow of hydraulic fluid passes to the hydraulic drive and a second position in which a portion of the flow of hydraulic fluid is diverted away from the hydraulic drive.

20. The high-pressure waterjet cutting system of claim 18, wherein the valve is positioned between the hydraulic drive and a sump and is movable between a first position in which the flow of drained hydraulic fluid is substantially unobstructed and a second position in which the flow of drained hydraulic fluid is obstructed.

21. The high-pressure waterjet cutting system of claim 20, wherein the pump is operable between a low speed and the normal speed and wherein operation of the pump at the low speed produces movement of the valve from the first position toward the second position.

* * * * *